United States Patent [19]

Ridley

[11] 4,153,110

[45] May 8, 1979

[54] IGNITION OF FRAGMENTED OIL SHALE BELOW A SILL PILLAR IN AN IN SITU OIL SHALE RETORT

[75] Inventor: Richard D. Ridley, Grand Junction, Colo.

[73] Assignee: Occidental Oil Shale, Inc., Grand Junction, Colo.

[21] Appl. No.: 805,692

[22] Filed: Jun. 13, 1977

[51] Int. Cl.[2] ..... E21B 43/24; E21B 43/26

[52] U.S. Cl. ..... 166/262; 166/52; 166/259; 299/2

[58] Field of Search ..... 166/256, 258–262, 166/302, 52; 299/2

[56] References Cited

U.S. PATENT DOCUMENTS

| | | | |
|---|---|---|---|
| 2,481,051 | 9/1949 | Uren | 299/2 |
| 2,497,868 | 2/1950 | Dalin | 166/256 |
| 2,801,089 | 7/1957 | Scott, Jr. | 299/2 |
| 3,004,597 | 10/1961 | Marx et al. | 166/262 |
| 3,076,505 | 2/1963 | Pryor | 166/262 |
| 3,349,848 | 10/1967 | Burgh | 166/262 X |
| 4,022,511 | 5/1977 | French | 299/2 |

*Primary Examiner*—Stephen J. Novosad
*Attorney, Agent, or Firm*—Christie, Parker & Hale

[57] ABSTRACT

An in situ oil shale retort is formed in a subterranean formation containing oil shale. The retort contains a fragmented permeable mass of particles containing oil shale. An open base of operation is excavated in the formation above the retort site, and an access drift is excavated to the bottom of the retort site. Formation is explosively expanded to form the fragmented mass in the retort between the access drift and an elevation spaced below the bottom of the base of operation, leaving a horizontal sill pillar of intact formation between the top of the retort and the bottom of the base of operation. The sill pillar has a vertical thickness sufficient to maintain a safe base of operation above the retort after the fragmented mass is formed. Prior to retorting, a particulate combustible material is placed in the blasting holes and ignited, and air is introduced to the ignited particulate combustible material to generate heated ignition gas for heating an upper portion the fragmented mass below the sill pillar to a temperature greater than the spontaneous ignition temperature of carbonaceous materials in the oil shale. Heated organic carbonaceous material is then contacted with oxygen supplying gas to establish a combustion zone in the fragmented mass. The combustion zone is advanced downwardly through the fragmented mass to provide retorting of particles containing oil shale. Liquid and gaseous products of retorting are withdrawn from the fragmented mass.

25 Claims, 3 Drawing Figures

IGNITION OF FRAGMENTED OIL SHALE BELOW A SILL PILLAR IN AN IN SITU OIL SHALE RETORT

BACKGROUND OF THE INVENTION

This application is related to U.S. patent application Ser. No. 603,704 entitled "In Situ Recovery of Shale Oil", filed Aug. 11, 1975 by Gordon B. French, now U.S. Pat. No. 4,043,595 to U.S. patent application Ser. No. 603,705 entitled "Forming Shale Oil Recovery Retort Into Slot-Shaped Columnar Void", filed Aug. 11, 1975 by Richard D. Ridley, now U.S. Pat. No. 4,043,596 and to U.S. patent application Ser. No. 790,350, entitled "In Situ Oil Shale Retort With a Horizontal Sill Pillar", filed Apr. 25, 1977, by Ned M. Hutchins. All three of these applications are assigned to the assignee of the present application and are incorporated herein by this reference.

This invention relates to recovery of liquid and gaseous products from oil shale. The term "oil shale" as used in the industry is in fact a misnomer; it is neither shale, nor does it contain oil. It is a sedimentary formation comprising marlstone deposit with layers containing an organic polymer called "kerogen" which upon heating decomposes to produce hydrocarbon liquid and gaseous products. The formation containing kerogen is called "oil shale" herein, and the hydrocarbon liquid product is called "shale oil".

One technique for recovering shale oil includes forming an in situ oil shale retort in a subterranean formation containing oil shale. At least a portion of the formation within the boundaries of the in situ oil shale retort is explosively expanded to form a fragmented permeable mass of particles containing oil shale. The fragmented mass is ignited near the top of the retort to establish a combustion zone. An oxygen-containing gas is introduced into the top of the retort to sustain the combustion zone and cause it to move downwardly through the fragmented permeable mass of particles in the retort. As burning proceeds, the heat of combustion is transferred to the fragmented mass of particles below the combustion zone to release shale oil and gaseous products therefrom in a retorting and vaporization zone. Vaporized constituents of shale oil, water vapor and the like may condense on cooler oil shale in the retort below the retorting zone. The retorting zone moves from top to bottom of the retort ahead of the combustion zone, and the resulting shale oil and gaseous products pass to the bottom of the retort for collection and removal. Recovery of liquid and gaseous products from oil shale deposits is described in greater detail in U.S. Pat. No. 3,661,423, to Donald E. Garrett, assigned to the assignee of this application.

In preparing for the retorting process the formation containing oil shale should be fragmented rather than simply fractured to create good and uniform permeability so that undue pressures are not required to pass the gas through the retort, and so that valuable deposits of oil shale are not bypassed owing to non-uniform permeability. The aforementioned patent applications disclose techniques for fragmenting a substantial volume of formation in a retort site to form a fragmented mass of particles in an in situ oil shale retort. The in situ retort is formed by excavating a void in the retort site, drilling blasting holes into the remaining portion of the formation in the retort site, loading explosive into the blasting holes, and detonating the explosive to expand the formation toward the void.

To promote uniformity of particle size and permeability of the fragmented mass, and to minimize the quantity of explosives, the blasting holes should be reasonably accurately located with respect to each other, and with respect to the void toward which expansion occurs during the explosion. Oil shale formations in the western United States are often between 50 to about 500 feet thick or even more, and are covered by a non-productive overburden, which may be thousands of feet deep, thus often making it difficult to drill from the surface and accurately locate blasting holes in the oil shale formation.

In one embodiment disclosed in application Ser. No. 790,350, and entitled "In Situ Oil Shale Retort With a Horizontal Sill Pillar", an open base of operation is excavated in the formation at a working level near the top of an in situ retort to be formed, which may be a thousand feet, or more, below the ground surface. A substantially horizontal access drift is excavated at a production level below the base of operation to provide access to a lower portion of the retort site. A void is excavated above the access drift so the void opens into the access drift and terminates below the base of operation at the top of the fragmented mass being formed. This leaves a substantially horizontal portion of intact formation between the top of the void and the bottom of the base of operation. The blasting holes for explosive for expanding formation are drilled from the base of operation through the formation on opposite sides of the void. Inasmuch as the working level is much closer to the top of the retort being formed than the distance from the retort to the overburden at the ground surface, this permits more accurate and rapid drilling of blasting holes from the base of operation than from the ground surface. This, in turn, facilitates explosive expansion to form the fragmented mass of oil shale particles in the retort.

In an embodiment disclosed in application Ser. No. 790,350, a horizontal sill pillar of unfragmented formation remains between the top of the fragmented mass in the retort and the bottom of the base of operation. The sill pillar has a number of bore holes through it after formation of the fragmented mass. Such bore holes include the upper ends of blasting holes drilled from the base of operation. Such bore holes can be used for access from the base of operation for establishing and sustaining a combustion zone in the fragmented mass below the sill pillar.

In the past a variety of techniques have been developed for igniting oil shale particles in an in situ retort in order to establish a combustion zone. One such technique is disclosed in U.S. patent application Ser. No. 578,203, filed May 16, 1975, and now U.S. Pat. No. 4,027,917, and U.S. Pat. No. 3,952,801, issued Apr. 27, 1976, to Robert S. Burton, III, and assigned to the assignee of this application. According to the techniques disclosed in these patents, a hole is bored to the top of the fragmented permeable mass and a burner is lowered through the bore hole to the oil shale to be ignited. A mixture of a combustible fuel such as LPG (liquefied petroleum gas) and oxygen containing gas, such as air, is burned in the burner, and the resultant flame is directed downwardly toward the fragmented permeable mass. The burning is conducted until a substantial portion of the oil shale has been heated above its ignition temperature so that combustion of carbonaceous material in the fragmented mass is self-sustaining. After ignition an oxygen supplying gas is introduced to the retort to advance the combustion zone through the retort.

It can be time consuming to establish a combustion zone in an oil shale retort. For example, a startup time as long as a week has been experienced with a retort in the South/Southwest portion of the Piceance Creek structural basin in Colorado. Such a long startup time results in consumption of large quantities of LPG, an expensive, premium fuel.

U.S. Pat. No. 3,454,958 to Parker describes a method whereby oil shale in the top of a nuclear chimney is ignited to establish a combustion zone across the bed of shale in the chimney. The combustion zone is established by burning a bed of charcoal soaked in a suitable fuel, such as diesel fuel, and forcing air up through the shale bed into the charcoal which is ignited by a fuse or similar device.

U.S. patent application Ser. No. 770,860, filed Feb. 22, 1977, by Chang Yul Cha, et al, entitled "Method of Igniting a Vertical In Situ Oil Shale Retort Filled With Fragmented Shale", and assigned to the assignee of this application, describes a method in which a void is excavated in a subterranean formation containing oil shale and combustible material is placed in the void adjacent an ignition situs. Formation is then explosively expanded toward the void to form a retort containing a fragmented permeable mass of formation particles containing oil shale. The top layer of the fragmented mass adjacent an ignition situs contains such combustible material. The combustible material is then ignited for establishing a combustion zone in the retort.

It is desirable to provide a relatively low cost method for quickly and effectively igniting oil shale particles in the upper portion of an in situ oil shale retort in order to establish a combustion zone in the retort. More specifically, it is desirable to provide a method in which oil shale can be ignited without requiring a burner to be lowered into the top of the retort, or requiring costly fuels to initiate combustion.

SUMMARY OF THE INVENTION

This invention provides a method for igniting a fragmented permeable mass of particles containing oil shale in an in situ oil shale retort. According to the method, the oil shale retort is formed in a subterranean formation containing oil shale which includes an open base of operation at an elevation above the top of the fragmented mass. Unfragmented formation is located between the top of the fragmented mass and the bottom of the base of operation. A plurality of bore holes extend through the unfragmented formation from the base of operation to the fragmented mass. Particles of combustible material are placed in at least a portion of the bore holes and the combustible material in such bore holes is ignited. An oxygen containing gas is introduced through the ignited particulate combustible material in such bore holes to generate a heated ignition gas which is introduced to the fragmented mass in order to ignite the fragmented mass and establish a combustion zone in the upper portion of the fragmented mass.

DRAWINGS

These and other aspects of the invention will be more fully understood by referring to the following detailed description and the accompanying drawings in which.

DESCRIPTION

General Description of Retort Forming

Figure 1:
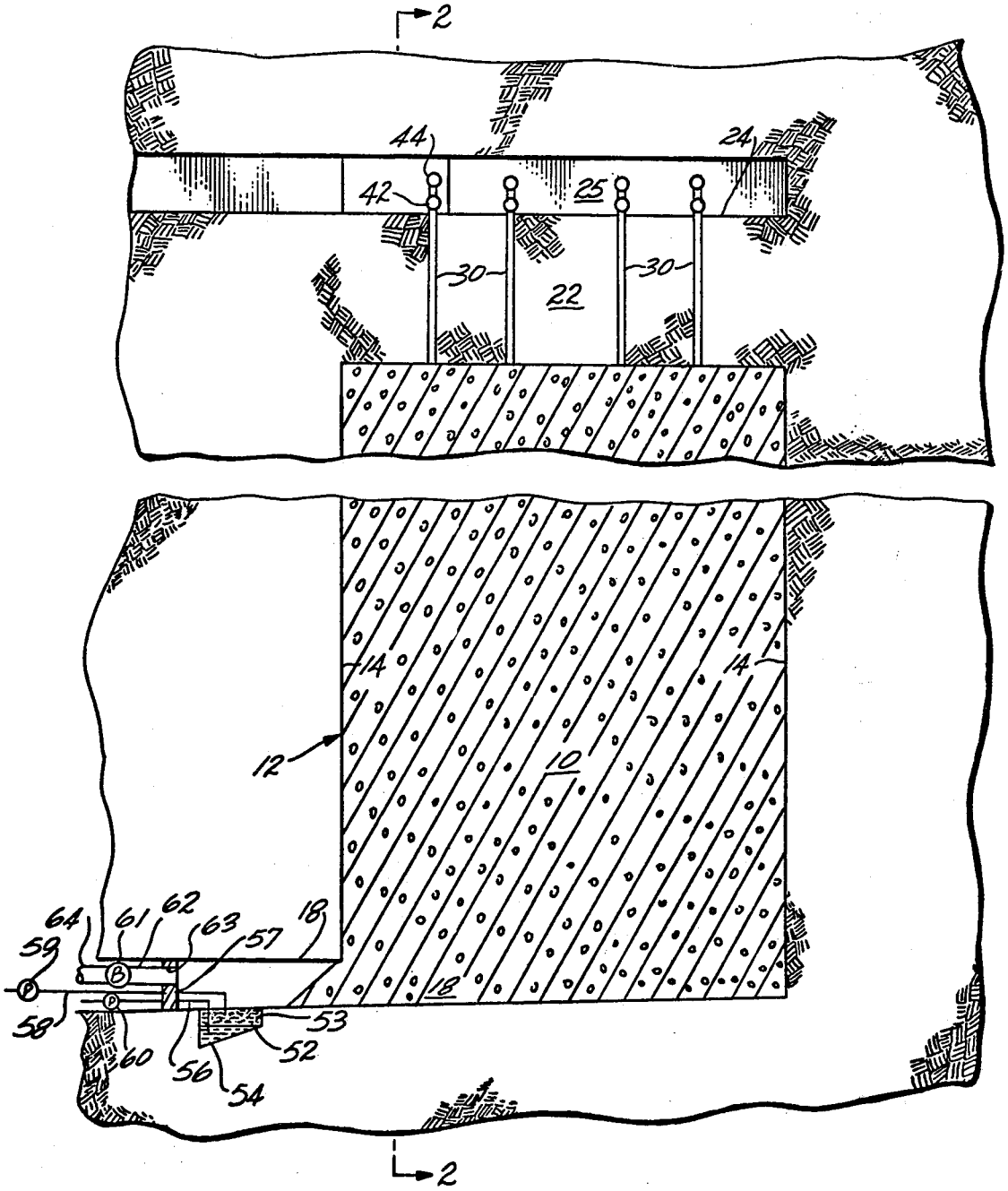
FIG. 1 is a semi-schematic vertical cross-sectional view showing one embodiment of an in situ oil shale retort constructed and operated in accordance with principles of this invention.

An in situ oil shale retort has a base of operation formed on a working level in a subterranean formation. This working level is at an upper elevation near the top of a retort being formed. A fragmented permeable mass of particles containing oil shale is formed below the base of operation by explosive expansion of formation toward an excavated void. The bottom of the base of operation is separated from the top boundary of the fragmented mass by a horizontal sill pillar of unfragmented formation. The horizontal sill pillar is sufficiently thick that it withstands stresses imposed by explosive expansion, as well as geologic stresses, to provide a safe base of operation after formation of the fragmented mass. This permits men and equipment to enter the base of operation over the top of the fragmented mass after explosive expansion. The base of operation on the working level can have a horizontal extent that permits effective access over substantially the entire horizontal cross-section of the fragmented mass, which is of great assistance in forming and operating an in situ retort.

After explosive expansion the base of operation is convenient as a location from which to ignite an upper portion of the fragmented mass and to control gas flow through the fragmented mass so as to establish a combustion zone in the fragmented mass.

In one method of forming an in situ oil shale retort in a formation containing oil shale, a portion of the formation is excavated to form a base of operation on an upper working level. A drift or similar means of access is excavated through formation at a lower production level to a location underlying the base of operation at or below the bottom of the in situ retort.

In preparing such a retort, at least one void is excavated from within the boundaries of the fragmented mass being formed, the void being connected to the access drift on the production level underlying the base of operation. This leaves another portion of the formation within the boundaries of the retort being formed which is to be fragmented by explosive expansion toward such a void. Such a void is excavated only to an elevation above the access drift that leaves a horizontal sill pillar of intact formation between the top of the void and the bottom of the base of operation. The surface of the formation defining the void provides at least one free face which extends through the formation, and the remaining portion of the formation within the boundaries of the retort being formed is explosively expanded toward such a free face.

In a preferred embodiment, the horizontal extent of the base of operation over the fragmented mass in the in situ retort is sufficient to provide effective access to substantially the entire horizontal cross-section of the fragmented mass. This does not require that there be an open excavation over the entire horizontal extent of the fragmented mass. Roof-supporting pillars can be left on the working level in a portion of the area directly above the fragmented mass. The size and arrangement of such working level pillars leaves an open base of operation having a sufficient horizontal extent to provide access to substantially the entire horizontal cross-section of the retort site. Such a base of operation facilitates excavation operations for forming a void for drilling and explosive loading for explosive expansion of formation toward such a void, and introduction of oxygen containing gas into the top of the fragmented mass below the horizontal sill pillar.

In one embodiment a plurality of vertically extending bore holes are drilled through the sill pillar into formation remaining below the sill pillar. The bore holes are sometimes referred to herein as "blasting holes" inasmuch as they are used to hold explosive for blasting the formation to form the fragmented permeable mass of particles containing oil shale. Such blasting holes can be ten inches or more in diameter. Smaller bore holes can also be present through the sill pillar. Explosive is loaded into such blasting holes from the base of operation up to a level about the same as the bottom of the horizontal sill pillar, which is to remain unfragmented. Such explosive is detonated for explosively expanding subterranean formation toward such a void below the sill pillar and forming a fragmented mass of formation particles in the retort while leaving unfragmented formation forming the sill pillar.

The base of operation can be used as a location from which to initiate and control advancement of the combustion zone through the retort. The flow of gas to the retort can be controlled from the base of operation to control establishment of the combustion zone and its advancement. According to the present invention, the base of operation is used as a location from which to introduce combustible materials to blasting holes in the sill pillar. The combustible material is ignited and used to generate a heated ignition gas for initiating such a combustion zone across the top of the fragmented mass in the retort.

Detailed Description

Figure 2:
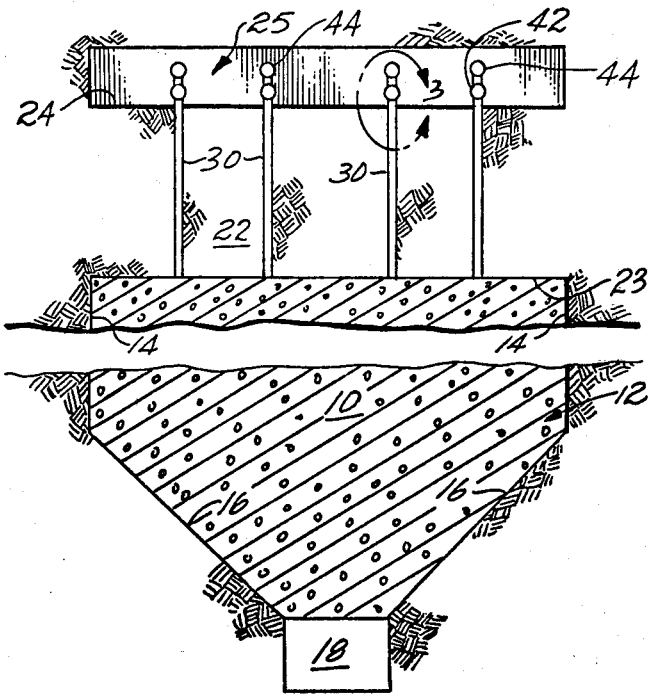
FIG. 2 is a vertical cross-sectional view taken on line 2—2 of FIG. 1.
Figure 3:
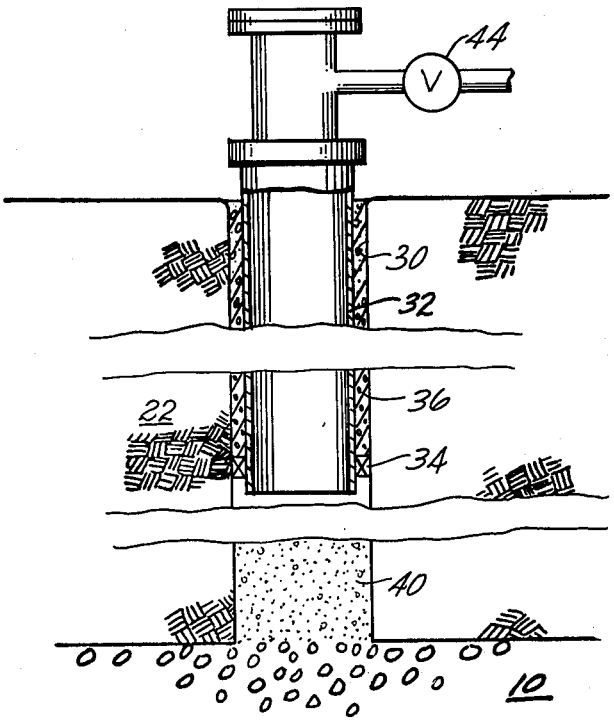
FIG. 3 is an enlarged semi-schematic cross-sectional view taken within the circle 3 of FIG. 2 and showing a casing located in a blasting hole extending through a horizontal sill pillar over the fragmented mass in an in situ retort and containing combustible materials.

Referring to FIGS. 1 and 2, a fragmented permeable mass 10 of formation particles containing oil shale is in an in situ oil shale retort 12 in a subterranean formation containing oil shale. The fragmented permeable mass has vertical side boundaries 14 substantially perpendicular to each other to give the retort a rectangular horizontal cross-section. The lower boundary 16 of the fragmented permeable mass slopes downwardly and inwardly (see FIG. 2) at an angle of about 45 and opens into the top of an elongated, substantially horizontal access drift 18 at the bottom of the retort 12. The access drift 18 has a gradual slope downwardly from the center of the bottom of the retort toward a sump 52 for recovering liquid products of retorting at the production level. The fragmented permeable mass also fills the portion of the access drift beneath the retort.

A horizontal sill pillar 22 of unfragmented formation forms the upper boundary 23 of the fragmented permeable mass in the retort. The top of the sill pillar 22 forms the floor 24 of an open base of operation 25 spaced above the fragmented mass by a distance equal to the thickness of the sill pillar. In this embodiment the base of operation 25 is an excavation 12 to 14 feet high at a working level above the retort. It extends over substantially the entire horizontal cross-section of the fragmented mass and opens at the left (as viewed in FIG. 1) to other excavations at the working level used for exploiting the oil shale deposit. Such underground workings open to a vertical shaft or horizontal adit (not shown).

A plurality of vertical blasting holes 30 extend through the sill pillar. The blasting holes remain in the sill pillar after the blasting which formed the fragmented mass in the retort. The blasting holes are aproximately uniformly distributed over the area of the sill pillar 22. In a working embodiment, the horizontal cross-section of the fragmented permeable mass is square, each side being about 120 feet long; and ten inch diameter blasting holes are located at intervals of about 25 feet and about 30 feet in a rectangular grid over essentially the entire horizontal cross section of the fragmented mass. Formation of such an in situ oil shale retort is described in detail in U.S. patent application Ser. No. 790,350, filed Apr. 25, 1977, and entitled "In Situ Oil Shale Retort With a Horizontal Sill Pillar".

During operation of the retort, gas used for retorting of the oil shale is passed downwardly through the fragmented mass. An oxygen containing gas is introduced into an upper portion of the fragmented permeable mass from the base of operation for sustaining a combustion zone in the fragmented mass and for advancing the combustion zone through the fragmented mass. The production level drift 18 provides a means for collecting and recovering liquid products and withdrawing off gas containing gaseous products from retorting oil shale in the retort 10. A variety of retorting techniques can be used, some of which are set forth in the prior art, so no further description of them is set forth herein.

A sump 52 in the region of the access drift 18 beyond the fragmented mass collects shale oil 53 and water 54 produced during operation of the retort. A water withdrawal line 56 extends from near the bottom of the sump out through a sealed opening (not shown) in a vertical barrier or bulkhead 57 sealed across the access drift. The water withdrawal line 56 is connected to a water pump 60. An oil withdrawal line 58 extends from an intermediate level in the sump out through a sealed opening (not shown) in the barrier and is connected to an oil pump 59. The oil and water pumps can be operated manually or by automatic controls (not shown) to remove shale oil and water separately from the sump.

The inlet of a blower 61 is connected by a conduit 62 to an opening 63 through the barrier 57 for withdrawing off gas from the retort. The outlet of the blower delivers off gas from the retort through a conduit 64 to a recovery or disposal system (not shown). Thus, the access drift 18 provides means for collecting and recovering liquid and gaseous products from the in situ oil shale retort. A variety of collection and recovery techniques can be used, some of which are set forth in the prior art.

According to the present invention, the base of operation 25 is used as a location from which to establish a combustion zone in the upper portion of the fragmented mass. The blasting holes 30 are used as a means for gaining access to the upper region of the retort initiate combustion in the retort. Separate vertical steel castings 32 are disposed in each of selected blasting holes prior to using the blasting holes to ignite the fragmented mass. A conventional external packer 34 at the lower end of each casing seals against the casing exterior and the adjacent portion of the horizontal sill pillar 22. The annular space between the casing and the sill pillar above the packer is filled with concrete or grout 36

(commonly referred to as cement) which anchors the casing securely in the sill pillar. In some situations, the casing can be adequately secured by using only the packer, or the cement can be replaced by drilling mud or the like to facilitate removal of the casing after the fragmented oil shale in the retort is completely treated. The casing can extend all the way through the sill pillar or can extend below the base of operation only a sufficient distance to seal the annulus between the casing and the formation and provide stability to the casing. In a working embodiment, 20 feet of casing was used with a sill pillar having a thickness of about 40 feet.

The fragmented mass is ignited by placing particles of a solid combustible material 40 in at least a portion of the blasting holes 30, and igniting the particles to generate a heated ignition gas used to ignite the fragmented mass. A large number of the blasting holes 30 can be used for placement of the combustible material 40 inasmuch as the blasting holes are distributed across essentially the entire horizontal cross-section of the fragmented mass. If desired, additional bore holes (not shown) for use in placement of the combustible materials can be drilled through the sill pillar 22 to provide access to a larger number of regions in the top of the fragmented mass.

The combustible material 40 can be a solid fuel such as coal, charcoal, peat, high grade oil shale, wood, or the like. By "high grade oil shale" is meant oil shale having a higher kerogen content per unit volume than the average kerogen content per unit volume of oil shale in the subterranean formation. A low grade combustible material such as subbituminous coal, lignite coal, peat, wood chips, or sawdust, which has minimal or no economic value, also can be used as the combustible material for this invention. Further, the solid material can be soaked with a liquid combustible material, such as shale oil, diesel fuel or the like.

The preferred combustible material has a lower ash content per unit of volume than the subterranean formation; and it has a higher heat of combustion than the average heat of combustion of oil shale in the subterranean formation. As used herein, "heat of combustion" refers to the amount of heat evolved by the combustion of a unit weight of the combustible material. With reference to oil shale, heat of combustion refers to the amount of heat evolved by a unit weight of oil shale, including non-combustible constituents of oil shale, and is not limited to just the kerogen contained in the oil shale.

The combustible material 40 should be a solid, i.e., a substance that does not flow perceptibly under moderate stress, so that the combustible material placed in the blasting holes 30 remains in place and forms a standing bed of material above the top boundary of the fragmented mass 10 in the retort. The bed of combustible material 40 in each blasting hole is sufficiently permeable to allow gas to flow down through the combustible material and into the top of the fragmented mass.

The combustible material in the blasting holes is ignited from locations within the base of operation 25, and air is then drawn down through the ignited combustible material to generate a heated ignition gas which is introduced from the blasting holes 30 to the top of the fragmented mass 10.

The air flow into the ignited combustible material 40 is generated by the blower 61 in the access drift 18, which produces a lower gas pressure in the access drift 18 than in the base of operation 25. This draws air from the base of operation 25 down into the permeable mass of combustible materials in the blasting holes. Ignition gas flows down into the fragmented mass 10, and out the access drift 18. The top of each casing 32 can be left open as air is drawn through the casings, or an air flow control valve 44 can be connected to the top of a casing to provide means for separately controlling air flow through the blasting holes from the base of operation.

The heated ignition gas generated in the blasting holes heats particles containing oil shale in the fragmented mass to a temperature greater than the spontaneous ignition temperature of carbonaceous materials in the oil shale particles. The heated carbonaceous materials in the fragmented mass are contacted with air being continuously drawn from the base of operation through the blasting holes, which initiates a combustion zone in the top of the fragmented mass.

Once one or more combustion zones are established in the regions of the fragmented mass where the heated ignition gas is introduced, the combustion zone or zones are propagated laterally across the top of the fragmented mass. Techniques can be used for advancing a combustion zone laterally across the top of the fragmented mass without significant downward advancement of the combustion zone until a combustion zone extends across the top of the fragmented mass. Thereafter, the combustion zone is advanced downwardly for retorting oil shale in a retorting zone in the fragmented mass on the advancing side of the combustion zone. The combustion zone is advanced downwardly through the fragmented mass by withdrawing off gas including combustion gas, gaseous products and other gases from the production level access drift 18. The blower 61 produces a lower gas pressure in the access drift than in the base of operation to draw air from the base of operation into the blasting holes and into the top of the fragmented mass to advance the combustion zone. This also produces a lower gas pressure at the bottom of the blasting holes 30 than in the base of operation so that the heated ignition gas generated in the blasting holes, or combustion gas generated in the fragmented mass will not flow into the base of operation.

This method requires minimal use of an expensive fuel such as liquefied petroleum gas inasmuch as a relatively low cost fuel such as low grade coal or charcoal, or high grade oil shale, bark or other wood chips, sawdust, or peat can be used to establish a combustion zone across the top of the fragmented mass in an in situ oil shale retort containing a fragmented permeable mass of particles containing oil shale. Further, the amount of auxiliary equipment required to initiate combustion is relatively minimal when using the method of this invention.

What is claimed is:

1. A method of recovering liquid and gaseous products from an in situ oil shale retort in a subterranean formation containing oil shale, the retort containing a fragmented permeable mass of formation particles containing oil shale, and in which the formation includes a subterranean open base of operation at an elevation spaced above the top of the fragmented mass, leaving unfragmented formation as a horizontal sill pillar between the top of the fragmented mass and the bottom of the base of operation, and a plurality of bore holes extending through the horizontal sill pillar from the subterranean base of operation to the fragmented mass, the method including the steps of:

placing a permeable mass of combustible material in at least one of such bore holes;

igniting the combustible material in such a bore hole;

introducing oxygen supplying gas through the ignited permeable mass of combustible material in such a bore hole to generate heated ignition gas in such bore hole; and introducing the heated ignition gas from such bore hole to the fragmented mass of particles containing oil shale to ignite the fragmented mass and establish a combustion zone therein.

2. The method according to claim 1 including introducing oxygen containing gas through the bore holes after ignition of the fragmented mass to sustain the combustion zone in the fragmented mass and to advance the combustion zone through the fragmented mass.

3. The method according to claim 2 including a means of access to a lower portion of the fragmented mass, and in which air is introduced through the bore holes after ignition of the fragmented mass by generating a lower gas pressure in the means for access than in the subterranean base of operation to draw air from the subterranean base of operation through the bore holes and into the fragmented mass.

4. The method according to claim 1 in which the combustible material is selected from the group consisting of particles of coal, charcoal, high grade oil shale, and wood.

5. The method according to claim 1 in which the combustible material has a higher heat of combustion than the average heat of combustion of the fragmented mass of particles in the retort.

6. The method according to claim 1 in which the combustible material has a lower ash content than the average ash content of the fragmented mass of particles in the retort.

7. The method according to claim 1 in which the bore holes are spaced apart and distributed across essentially the entire horizontal cross section of the fragmented mass.

8. The method according to claim 1 in which the combustible material is placed in such a bore hole from a location within the subterranean base of operation.

9. The method according to claim 1 including adding further combustible material to such bore holes as combustible material therein becomes depleted in generating heated ignition gas.

10. A method of recovering liquid and gaseous products from an in situ oil shale retort in a subterranean formation containing oil shale, the retort containing a fragmented permeable mass of formation particles containing oil shale, and in which the formation includes a subterranean open base of operation at an elevation spaced above the top of the fragmented mass, leaving unfragmented formation as a horizontal sill pillar between the top of the fragmented mass and the bottom of the base of operation, a plurality of bore holes extending through the horizontal sill pillar from the subterranean base of operation to the fragmented mass, and a means of access to a lower portion of the fragmented mass, the method including the steps of:

placing a permeable mass of combustible material in at least one of such bore holes;

igniting the combustible material in such a bore hole;

generating a lower gas pressure in the means of access than in the base of operation to draw air from the base of operation into the ignited combustible material in such a bore hole to generate heated ignition gas in such bore hole; and introducing the heated ignition gas from such bore hole to the fragmented mass of particles containing oil shale to ignite the fragmented mass and establish a combustion zone therein.

11. The method according to claim 10 including introducing oxygen-containing gas through the bore holes after ignition of the fragmented mass to sustain the combustion zone in the fragmented mass and to advance the combustion zone through the fragmented mass.

12. The method according to claim 10 in which air is introduced through the bore holes after ignition of the fragmented mass by generating a lower gas pressure in the means for access than in the subterranean base of operation to draw air from the subterranean base of operation through the bore holes and into the fragmented mass.

13. The method according to claim 10 in which the bore holes are spaced apart and distributed across essentially the entire horizontal cross section of the fragmented mass.

14. A method for establishing a combustion zone in an in situ oil shale retort in a subterranean formation containing oil shale in which the retort contains a fragmented permeable mass of formation particles containing oil shale, said fragmented mass having top, bottom and side boundaries, and in which the formation includes a subterranean open base of operation above the top boundary of the fragmented mass, a horizontal sill pillar of unfragmented formation between the top of the fragmented mass and the bottom of the subterranean base of operation for effective access to substantially the entire horizontal cross-section of the fragmented mass, and a plurality of bore holes extending from the subterranean base of operation through the sill pillar to the top boundary of the fragmented mass, the method comprising the steps of:

providing a permeable mass of particles of solid combustible material in a plurality of such bore holes in communication with a top portion of the fragmented mass;

igniting the combustible material in such bore holes;

introducing air to the ignited combustible material in the bore holes to generate heated ignition gas in the bore holes; and introducing the heated ignition gas from the bore holes to the fragmented mass of particles containing oil shale to ignite the fragmented mass and establish a combustion zone therein.

15. The method according to claim 14 in which the bore holes are substantially filled with particulate combustible material.

16. The method according to claim 14 including introducing air through such bore holes after ignition of the fragmented mass to sustain the combustion zone in the fragmented mass and to advance the combustion zone through the fragmented mass.

17. The method according to claim 16 in which the combustible material has a higher heat of combustion than the average heat of combustion of the fragmented mass of particles in the retort.

18. The method according to claim 14 in which the combustible material is placed in the bore holes from locations within the subterranean base of operation.

19. The method according to claim 14 in which the combustible material is selected from the group consisting of particles of coal, charcoal, high grade oil shale, and wood.

20. The method according to claim 14 in which the bore holes are spaced apart and distributed across essentially the entire horizontal cross section of the fragmented mass.

21. A method for establishing a combustion zone in an in situ oil shale retort in a subterranean formation containing oil shale in which the retort contains a fragmented permeable mass of formation particles containing oil shale, said fragmented mass having top, bottom and side boundaries, and in which the formation includes a subterranean open base of operation above the top boundary of the fragmented mass, a horizontal sill pillar of unfragmented formation between the top of the fragmented mass and the bottom of the subterranean base of operation for effective access to substantially the entire horizontal cross-section of the fragmented mass, and a plurality of bore holes extending from the subterranean base of operation through the sill pillar to the top boundary of the fragmented mass, the method comprising the steps of:

providing a permeable mass of particles of solid combustible material in a plurality of such bore holes in communication with a top portion of the fragmented mass;

igniting the combustible material in such bore holes;

producing a lower gas pressure in a lower portion of the fragmented mass than in the subterranean base of operation so that air is drawn from the subterranean base of operation through the bore holes and into the mass of ignited combustible material for generating heated ignition gas in the bore holes; and introducing the heated ignition gas from the bore holes to the fragmented mass of particles containing oil shale to ignite the fragmented mass and establish a combustion zone therein.

22. The method according to claim 21 in which the bore holes are spaced apart and distributed across essentially the entire horizontal cross section of the fragmented mass.

23. The method according to claim 21 including adding further combustible material to such bore holes as combustible material therein becomes depleted in generating heated ignition gas.

24. The method according to claim 21 including introducing air through such bore holes after ignition of the fragmented mass to sustain the combustion zone in the fragmented mass and to advance the combustion zone through the fragmented mass.

25. The method according to claim 21 in which the combustible material is selected from the group consisting of particles of coal, charcoal, high grade oil shale, and wood.

* * * * *